United States Patent [19]

Ruane

[11] Patent Number: 4,662,611

[45] Date of Patent: May 5, 1987

[54] GUARD RAIL ASSEMBLY

[76] Inventor: George W. Ruane, 239 W. McMillan St., Cincinnati, Ohio 45219

[21] Appl. No.: 833,152

[22] Filed: Feb. 27, 1986

[51] Int. Cl.[4] ..... A01K 3/00; E04H 17/14

[52] U.S. Cl. ..... 256/13.1; 256/19

[58] Field of Search ..... 256/13.1, 19; 114/220; 104/256

[56] References Cited

U.S. PATENT DOCUMENTS

| | | | |
|---|---|---|---|
| 1,449,518 | 3/1923 | Lawson | 256/13.1 |
| 3,084,517 | 4/1963 | Bell | 114/220 X |

FOREIGN PATENT DOCUMENTS

| | | | |
|---|---|---|---|
| 2148219 | 4/1973 | Fed. Rep. of Germany | 256/13.1 |
| 1522918 | 3/1968 | France | 256/13.1 |

*Primary Examiner*—Andrew V. Kundrat

*Attorney, Agent, or Firm*—James W. Pearce; Roy F. Schaeperklaus

[57] ABSTRACT

A guard rail assembly for a highway. Upright posts are mounted in a line adjacent an edge of the highway. A horizontal guide member is mounted on each post. A bar is mounted for horizontal sliding movement on each guide member. An elongated guard rail member is mounted on the bars. Shock absorber assembly means between the posts and the guard rail member resist rapid outward movement of the guard rail member while permitting controlled outward movement of the guard rail member. The guard rail may carry rollers to reduce friction and ease movement of an engaging vehicle along the guard rail.

2 Claims, 5 Drawing Figures

GUARD RAIL ASSEMBLY

BACKGROUND OF THE INVENTION

This invention relates to a highway guard rail. More particularly, this invention relates to a guard rail structure which can yield under impact and which produces a reduced resistance to advancement of a vehicle in a selected direction.

BRIEF DESCRIPTION OF THE INVENTION

Briefly, the invention provides a guard rail assembly which includes support posts arranged in a line along a highway section. An elongated rail member is mounted for advancing horizontally and transversely of the line of posts. Shock absorber means between the posts and the guard rail member resist movement of the guard rail assembly from an extended position. Roller means mounted on the guard rail assembly permit a vehicle which impacts the guard rail assembly to advance lengthwise of the rail assembly.

The above and other objects and features of the invention will be apparent to those skilled in the art to which this invention pertains from the following detailed description and the drawings, in which:

BRIEF DESCRIPTION OF THE DRAWING

In the following detailed description and the drawing, like reference characters indicate like parts.

DESCRIPTION OF PRESENTLY PREFERRED EMBODIMENT

Figure 1:
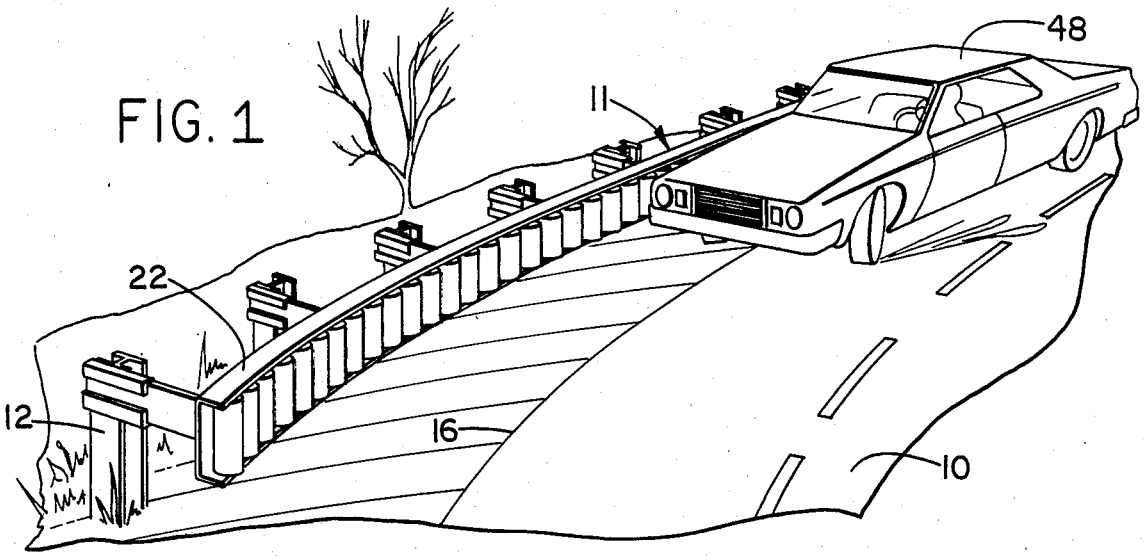
FIG. 1 is a perspective view of a fragmentary portion of a highway provided with a guard rail assembly constructed in accordance with an embodiment of this invention, a vehicle being shown in association therewith.
Figure 2:
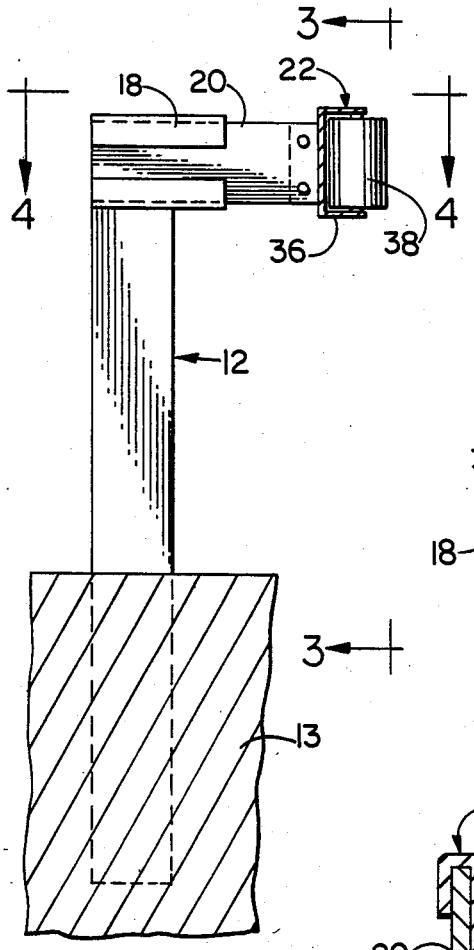
FIG. 2 is a view in upright section of the guard rail assembly.
Figure 4:
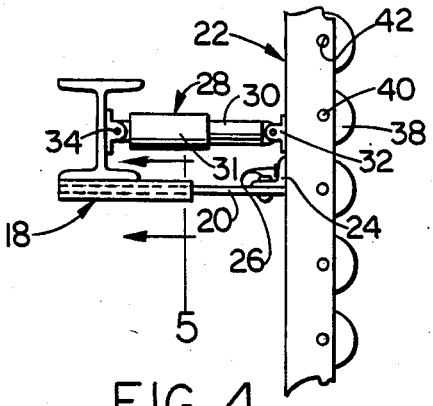
FIG. 4 is a plan view taken in the direction of the arrows 4—4 in FIG. 2.
Figure 3:
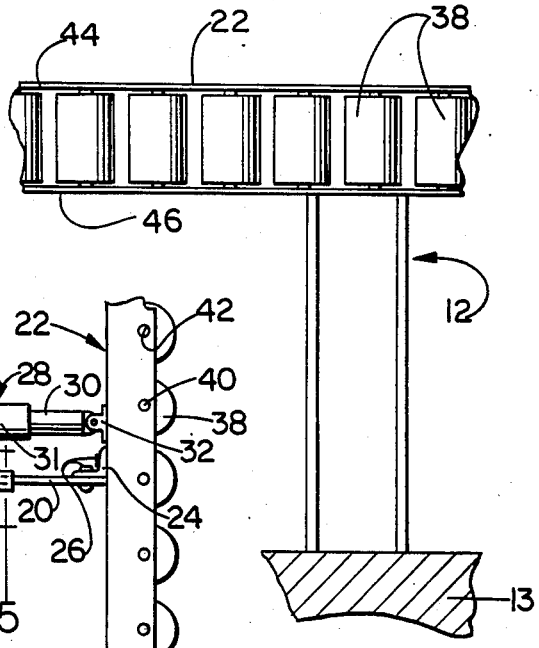
FIG. 3 is a fragmentary view in section taken generally on the line 3—3 in FIG. 2.
Figure 5:
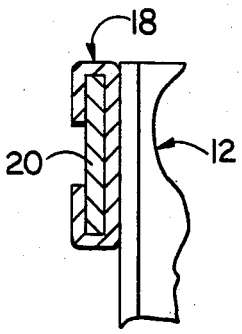
FIG. 5 is a view in section taken on the line 5—5 in FIG. 4.

In the drawing is shown a fragmentary portion of a highway 10 adjacent which is mounted a guard rail assembly 11 constructed in accordance with an embodiment of this invention. The guard rail assembly includes a plurality of upright posts 12, each of which can be of I-shape in cross section. The posts 12 are mounted in ground 13 along a line (not shown in detail) spaced from an edge 16 of the highway 10. On an end face of each post is mounted a guide member 18 which guides a horizontal bar 20 for horizontal movement transversely of the line of mounting of the posts 12. The horizontal bars 20 are attached to an elongated guard rail member 22 by means of angle members 24 and bolts 26. Each post also supports a shock absorber assembly 28. Each shock aborber assembly includes a first telescoping member 30 and a second telescoping member 31. The members 30 and 31 can be provided with appropriate interconnections (not shown) so that telescoping movement is resisted but is not prevented. The first member 30 of each shock absorber assembly is attached to the guard rail member 22 by means of a bracket 32 and appropriate fasteners, not shown in detail. The second member 31 of each shock absorber assembly is attached to a web portion of an associated post 12 by means of a bracket 34 and appropriate fasteners, not shown.

The guard rail member 22 includes a body 36 which is of channel shape. Mounted between flanges 44 and 46 of the body 36 are rollers 38. The rollers are mounted on upright shafts 40 which are journaled in openings 42 in the flanges 44 and 46 of the guard rail member 22.

When a vehicle 48 travels off the highway 10 and runs into the guard rail assembly, as shown in FIG. 1, the guard rail member 22 can be pushed toward the posts 12. However, the shock absorber assemblies 28 can resist rapid movement of the guard rail member 22 away from the highway. The rollers 38 permit the vehicle to advance lengthwise of the guard rail member 22. However, rapid advance of the vehicle away from the highway 10 is resisted by the guard rail assembly.

The guard rail assembly illustrated in the drawing and described above is subject to structural modification without departing from the spirit and scope of the appended claims.

Having described my invention, what I claim as new and desire to secure by Letters Patent is:

1. A guard rail assembly for a highway which comprises a line of upright posts mounted adjacent an edge of the highway, a horizontal guide member mounted on each post, a bar mounted for horizontal sliding on each guide member, an elongated guard rail member mounted on the bars and shock assembly means between the posts and the guard rail member to resist rapid outward movement of the guard rail member while permitting controlled outward movement of the guard rail member.

2. A guard rail assembly as in claim 1 which includes a plurality of guide rollers rotatably mounted on the guard rail member and arranged to guide a vehicle for movement lengthwise of the guard rail member.

* * * * *